US010718182B2

(12) United States Patent
Biedermann

(10) Patent No.: US 10,718,182 B2
(45) Date of Patent: Jul. 21, 2020

(54) PORTED COLLAR AND A RESETTABLE ACTIVATING DEVICE FOR USE WITH A DOWNHOLE TUBULAR

(71) Applicant: TIER 1 ENERGY SOLUTIONS INC., Edmonton (CA)

(72) Inventor: Randal Brent Biedermann, Edmonton (CA)

( * ) Notice: Subject to any disclaimer, the term of this patent is extended or adjusted under 35 U.S.C. 154(b) by 0 days.

(21) Appl. No.: 16/373,458

(22) Filed: Apr. 2, 2019

(65) Prior Publication Data

US 2019/0301268 A1 Oct. 3, 2019

Related U.S. Application Data

(60) Provisional application No. 62/651,527, filed on Apr. 2, 2018.

(51) Int. Cl.

| | |
|---|---|
| ***E21B 34/14*** | (2006.01) |
| ***E21B 34/10*** | (2006.01) |
| ***E21B 33/129*** | (2006.01) |
| ***E21B 33/128*** | (2006.01) |
| ***E21B 43/26*** | (2006.01) |

(52) U.S. Cl.

CPC ..... *E21B 34/14* (2013.01); *E21B 33/128* (2013.01); *E21B 33/1293* (2013.01); *E21B 34/10* (2013.01); *E21B 43/26* (2013.01); *E21B 2200/06* (2020.05)

(58) Field of Classification Search

CPC ..... E21B 2034/007; E21B 33/128; E21B 33/1293; E21B 34/10; E21B 34/14; E21B 43/26

See application file for complete search history.

(56) References Cited

U.S. PATENT DOCUMENTS

2015/0053408 A1* 2/2015 Purkis ..... E21B 43/26 166/308.1
2016/0032670 A1* 2/2016 Webster ..... E21B 23/004 166/381
2018/0202269 A1 7/2018 Wensrich et al.

FOREIGN PATENT DOCUMENTS

WO 2018183955 10/2018

OTHER PUBLICATIONS

Springer Oil Tools, "Springer Hydraulic 'No Drillout' Stage Tool", online at: http://springeroiltools.com/pageB.asp?rtnCat=cem004&list_code=cem004#white_wrapper.

* cited by examiner

*Primary Examiner* — James G Sayre
(74) *Attorney, Agent, or Firm* — Bennett Jones LLP

(57) ABSTRACT

A ported collar has a tubular body that forms part of or is installed in a tubular that is run into a wellbore, and defines a port for permitting radial fluid communication into or out of the ported collar. A sleeve is movable relative to the port to vary an open area of the port. The activation device includes a fixed key and a traveling key movable relative to the fixed key. The activation device is inserted into the tubular body of the ported collar. A fixed key profile is releasably mated with a tubular body key profile to fix the position of the activation device in the ported collar. A traveling key profile is releasably mated with a sliding sleeve key profile, and the traveling key is moved relative to the fixed key to move the sliding sleeve, and thereby vary the open area of the port.

8 Claims, 6 Drawing Sheets

PORTED COLLAR AND A RESETTABLE ACTIVATING DEVICE FOR USE WITH A DOWNHOLE TUBULAR

FIELD OF THE INVENTION

The present invention relates to a ported collar for forming part of being installed in a downhole tubular, and a resettable activating device insertable therein, and a related method for controlling radial fluid communication into or out of the ported collar. The present invention may be used for the stimulation of a plurality of zones in a subterranean formation.

BACKGROUND OF THE INVENTION

A subterranean formation may be stimulated to increase the production rate of reservoir fluids. Stimulation may be accomplished in a variety of ways, with the specific stimulation technique often being selected based upon the specific geological structures in the subterranean formation and/or the specific reservoir fluids that may be removed therefrom. For example, oil shale formations may be stimulated through the use of hydraulic fracturing, with the resulting fractures serving as fluid conduits for the removal of shale oil from the oil shale formation. In another example, an acid solution may be supplied to a carbonate formation to dissolve a portion of the carbonate formation and create one or more fluid conduits therein. Combinations of different stimulation techniques are often used.

It may sometimes be desirable to stimulate a specific region, or zone, of a subterranean formation. A stimulation well may be drilled into the formation and may be utilized to provide one or more stimulant fluids to the formation, such as to one or more regions of the formation that includes the desired resource to be produced, so called "pay zones". A portion of a wellbore that is associated with the well may be present within a pay zone of the formation, while a remainder of the wellbore may be outside the pay zone. In such a case, it may be desirable to direct stimulant fluids into the pay zone only. Additionally or alternatively, it may be desirable to independently, systematically, and/or selectively provide the stimulant fluid to a plurality of sub-regions, or subzones, within the pay zone.

Historically, coiled tubing and/or ball actuated systems have been utilized to provide stimulant fluids to specific or desired regions of the formation. However, these systems may be expensive to implement, time-consuming to utilize, may only provide for stimulation of a limited number of regions within the subterranean formation, may only provide for stimulation of specific predetermined regions of the subterranean formation and/or may not be effective when utilized in long wellbores. Thus, there exists a need for improved systems and methods for stimulating subterranean formations.

SUMMARY OF THE INVENTION

The present invention provides a ported collar and a resettable activating device. The ported collar has a tubular body that forms part of or is installed in a tubular that is run into a wellbore, and defines a port. A sleeve is movable relative to the port to vary an open area of the port. The activation device includes a fixed key and a traveling key movable relative to the fixed key. The activation device is inserted into the tubular body of the ported collar. A fixed key profile is releasably mated with a tubular body key profile to fix the position of the activation device in the ported collar. A traveling key profile is releasably mated with a sliding sleeve key profile, and the traveling key is moved in a first direction relative to the fixed key to move the sliding sleeve to vary the open area of the port. The present invention is used to control radial fluid communication into or out of the ported collar. In one non-limiting embodiment, the ported collar may be a frac collar. In a non-limiting exemplary use, the present invention may be used for permitting a fracturing fluid or a stimulant fluid flowing through the ported collar to flow outside of the frac collar and into the surrounding zone of a subterranean formation.

In one aspect, the present invention comprises a ported collar for forming part of or for being installed in a tubular that is run into a wellbore defining an axial direction and a radial direction, and for use with an activation device insertable in the ported collar and comprising a fixed key having a radially outward facing fixed key profile and a traveling key having a radially outward facing traveling key profile. The ported collar comprises a tubular body for forming part of or for being installed in the tubular, and defining at least one port permitting radial fluid communication between inside the tubular body and outside the tubular body. The ported collar comprises a sleeve movable relative to the at least one port to vary an open area of the port permitting radial fluid communication between inside the tubular body and outside the tubular body. The tubular body defines a radially inward facing tubular body key profile for mating with the fixed key profile of the activation device to fix an axial position of the activation device when disposed in the tubular body. The sleeve defines a radially inward facing sleeve key profile for mating with the traveling key profile of the activation device, such that movement of the traveling key actuates movement of the sleeve to vary the open area of the port permitting radial fluid communication between inside the tubular body and outside the tubular body.

In one embodiment of the ported collar, the tubular body key profile is different from the sleeve key profile, such that the fixed key profile is not mateable with the sleeve key profile.

In one embodiment of the ported collar, the sleeve is movable relative to the at least one ported port by axial sliding motion.

In one embodiment of the ported collar, the sleeve is movable relative to the at least one port by rotational motion about an axis parallel to the axial direction.

In another aspect, the present invention comprises a resettable activation device for insertion into a ported collar for forming part of or for being installed in a tubular that is run into a wellbore defining an axial direction and a radial direction, the ported collar comprising a tubular body defining at least one port permitting radial fluid communication between inside the tubular body and outside the tubular body, and a sleeve movable relative to the at least one port to vary an open area of the port permitting radial fluid communication between inside the tubular body and outside the tubular body, wherein the tubular body defines a radially inward facing tubular body key profile, and wherein the sleeve defines a radially inward facing sleeve key profile. The resettable activation device comprises a mandrel comprising an uphole head adapted to attach to a wireline or a coiled tubing string. The resettable activation device comprises a fixed key affixed to the mandrel, wherein the fixed key defines a radially outward facing fixed key profile for mating with the tubular body key profile to fix an axial position of the activation device when disposed in the tubular body. The resettable activation device comprises a traveling piston disposed on the mandrel for reciprocating axially on the mandrel. The resettable activation device comprises a traveling key affixed to traveling piston, wherein the traveling key defines a radially outward facing traveling key profile for mating with the sleeve key profile. The resettable activation device comprises a hydraulic power module configured for actuating axial reciprocation of the traveling piston on the mandrel when the traveling key profile is mated with the sleeve key profile, thereby moving the sleeve to vary the open area of the port permitting radial fluid communication between inside the tubular body and outside the tubular body.

In one embodiment of the resettable activation device, the fixed key profile is different from the traveling key profile, such that the fixed key profile is not mateable with the sleeve key profile.

In one embodiment of the resettable activation device, the hydraulic power module is further configured for actuating the fixed key relative to the mandrel between a radially retracted position in which the fixed key profile is not mateable with the tubular body key profile, and a radially deployed position in which the fixed key profile is mateable with the tubular body key profile.

In one embodiment of the resettable activation device, the hydraulic power module is further configured for actuating the traveling key relative to the mandrel between a radially retracted position in which the traveling key profile is not mateable with the sleeve key profile, and a radially deployed position in which the traveling key profile is mateable with the sleeve key profile.

In one embodiment of the resettable activation device, the resettable activation device further comprises a packer mounted on the mandrel, wherein the packer is responsive to axial compression to expand radially and seal against an inner surface of the tubular body of the ported collar. The resettable activation device further comprises a packer actuating piston disposed on the mandrel for reciprocating axially on the mandrel, wherein axial reciprocation of the packer actuating piston alternately axially compresses and decompresses the packer. The hydraulic power module is further configured for actuating axial reciprocation of the packer actuating piston on the mandrel.

In one embodiment of the resettable activation device, the resettable activation device further comprises an anchor slip for anchoring the device within the tubular body of the ported collar, or a centralizer to centralize the device within the ported collar. The anchor slip or the centralizer is responsive to an axial force to move from a radially retracted position in which the anchor slip or the centralizer does not engage an inner surface of the tubular body of the ported collar, to a radially deployed position in which the anchor slip or the centralizer engages the inner surface of the tubular body of the ported collar. The resettable activation device further comprises a ramp member disposed on the mandrel for reciprocating axially on the mandrel to apply the axial force to the anchor slip or the centralizer.

In another aspect, the present invention comprises a method for operating at least one ported collar comprising a tubular body forming part of or being installed in a tubular that is run into a wellbore defining an axial direction and a radial direction, and defining at least one port permitting radial fluid communication between inside the tubular body and outside the tubular body, and a sleeve movable relative to the at least one port to vary an open area of the port permitting radial fluid communication between inside the tubular body and outside the tubular body. The method comprises the steps of:

(a) inserting an activation device into the tubular body of a first one of the at least one collar, wherein the activation device comprises:
  (i) a fixed key defining a radially outward facing fixed key profile; and
  (ii) a traveling key movable relative to the fixed key, and defining a radially outward facing traveling key profile;
(b) mating the fixed key profile with the tubular body key profile of the first ported collar to fix an axial position of the activation device in the tubular body of the first ported collar;
(c) mating the traveling key profile with the sliding sleeve key profile of the first ported collar; and
(d) moving the traveling key relative to the fixed key to move the sliding sleeve of the first ported collar to vary the open area of the port permitting radial fluid communication between inside the tubular body and outside the tubular body.

In one embodiment of the method, the method is performed to permit a fracturing fluid or a stimulation fluid to flow radially through the at least port into a zone of subterranean formation surrounding the first ported collar.

In one embodiment of the method, the method further comprises the steps of:

(a) unmating the traveling key profile with the sliding sleeve key profile of the first ported collar; and
(b) unmating the fixed key profile with the tubular body key profile to release the axial position of the activation device in the tubular body of the first ported collar; and
(c) moving the actuating device uphole or downhole in the wellbore to a second one of the at least one ported collar, and repeating steps (a) to (d) of the method in respect to the second ported collar.

In one embodiment of the method, inserting the activation device into the tubular body of the first ported collar comprises running the activation device on a wireline or a coiled tubing string.

In one embodiment of the method, mating the fixed key profile with the tubular body key profile of the first ported collar comprises actuating the fixed key profile to move radially outward towards the tubular body key profile of the first ported collar.

In one embodiment of the method, mating the traveling key profile with the sliding sleeve key profile of the first ported collar comprises actuating the traveling key profile to move radially outward towards the sliding sleeve key profile of the first ported collar.

In one embodiment of the method: the activation device further comprises a packer that is responsive to axial compression to expand radially and seal against an inner surface of the tubular body of the first ported collar, and a packer actuating piston movable to axially compress the packer; and the method further comprises the step of moving the packer actuating piston to axially compress the packer and expand the packer radially to seal against the inner surface of the tubular body of the first ported collar.

In one embodiment of the method: the activation device further comprises an anchor slip for anchoring the device within the tubular body of the ported collar, a centralizer to centralize the device within the ported collar, wherein the anchor slip or the centralizer is responsive to an axial force to move from a radially retracted position in which the anchor slip or the centralizer does not engage an inner surface of the tubular body of the ported collar, to a radially deployed position in which the anchor slip or the centralizer engages the inner surface of the tubular body of the ported collar; and the method further comprises the step of moving a ramp member to apply the axial force to the anchor slip.

BRIEF DESCRIPTION OF THE DRAWINGS

In the drawings shown in the specification, like elements may be assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention.

DETAILED DESCRIPTION OF PREFERRED EMBODIMENTS

Definitions. As used herein, the term "axial" refers to a direction substantially parallel to the longitudinal direction of a wellbore—i.e., the direction between the toe and the head of the wellbore. As used herein, the term "radial" refers to a direction perpendicular to the axial direction. It will be understood that the orientation of the axial direction may be different in different portions of the wellbore. For example, in a vertically extending portion of the wellbore, the axial direction is vertical, whereas in a horizontally extending portion of the wellbore, the axial direction is horizontal.

As used herein, the term "frac" is the colloquial term denoting "fracture", "fracturing" or the like, as the context requires.

As used herein, the term "wireline" includes the term "e-line", which is a wireline with electric wire components, as is well-known in the art. As used herein, the term "coiled tubing" includes the term "e-coil tubing", which refers to electric coiled tubing, which is coiled tubing with electric wire components, as is well-known in the art.

Figure 1:
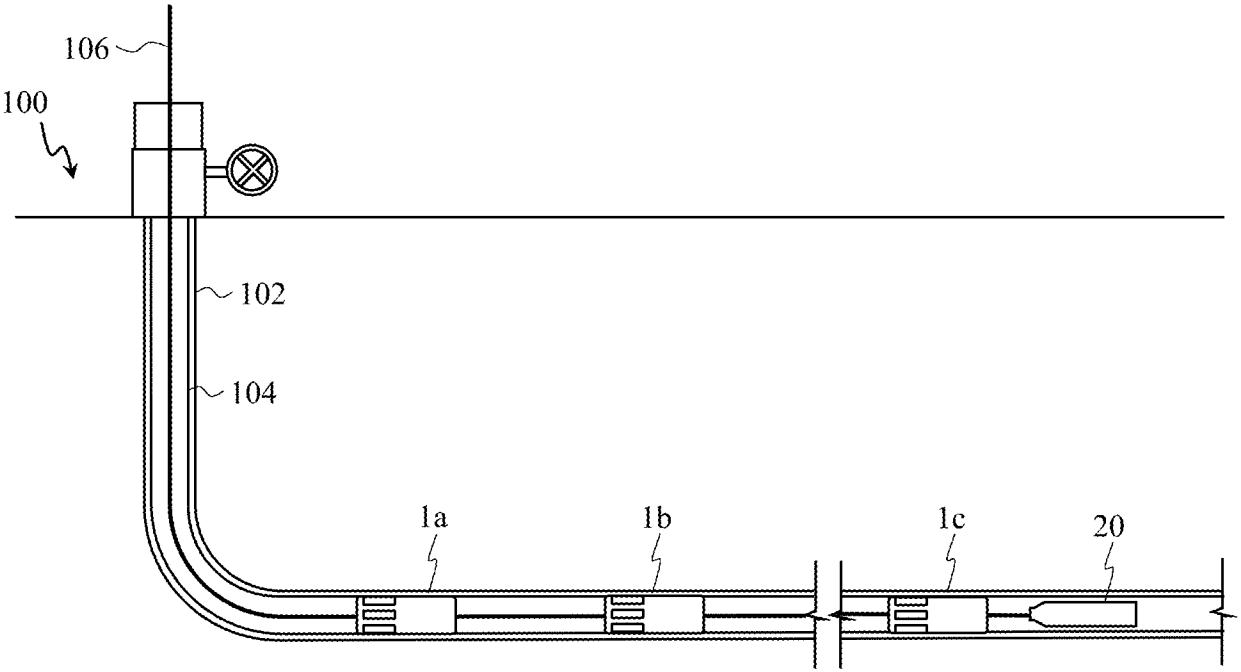
FIG. 1 is an elevation view of embodiment of a system of the present invention comprising a frac collar of the present invention and an activation device of the present invention, when disposed in a wellbore.

System. FIG. 1 is a cross-sectional view of an embodiment of the system (100) of the present invention in relation to a wellbore (102). In this embodiment, the wellbore (102) includes a vertical section and a horizontal section. A plurality of ported collars in the form of frac collars (1*a*, 1*b*, 1*c*) of the present invention form part of or are installed in a tubular (104), such that the frac collars (1*a*, 1*b*, 1*c*) are placed in different zones of the subterranean formation surrounding the wellbore (102). For example, the tubular (104) may be a casing string that lines the wellbore (102), but it is also conceivable that the tubular (104) could be distinct from and contained within a perforated casing string that lines the wellbore (102). The frac collars (1*a*, 1*b*, 1*c*) are individually actuated by an activation device (20) of the present invention to permit a fracturing fluid or a stimulant fluid to flow from the tubular (104) into the formation zones surrounding the frac collars (1*a*, 1*b*, 1*c*).

Figure 2:
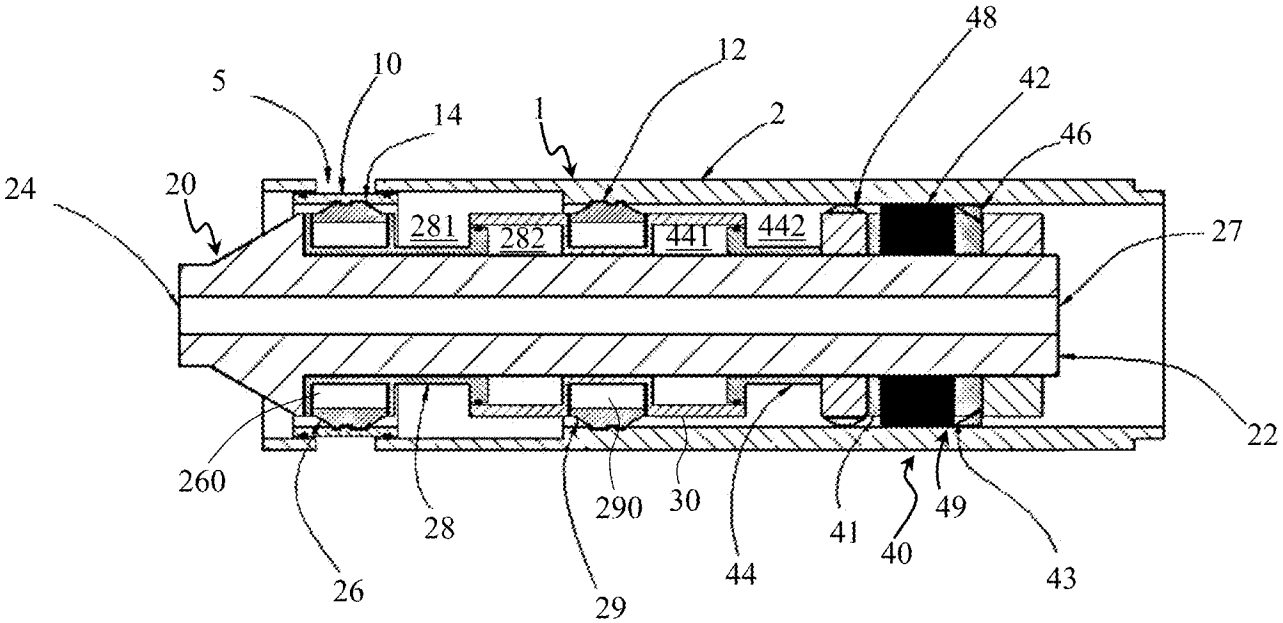
FIG. 2 is a midline cross-sectional view of one embodiment of an activation device of the present invention, landed in a frac collar of the present invention. A hydraulic power module is not shown.

Frac collar. FIG. 2 shows a cross-sectional view of an embodiment of a frac collar (1) of the present invention, with an embodiment of a resettable activation device (20) of the present invention landed therein. In FIG. 2, the left side and right side of the drawing are directed toward the uphole end and the downhole end, respectively.

Each frac collar (1) comprises a tubular body (2) that defines at least one and possibly a plurality of frac ports (5), which open to provide fluid communication to the formation. A sliding sleeve (10) may reciprocate axially relative to the frac port (5) to open and close the frac port (5). In one embodiment, the sliding sleeve (10) may slide longitudinally within the frac collar (1). In other embodiments, a rotating sleeve may rotate relative to the frac port (5) to open and close the frac port (5).

The frac collar (1) has a fixed tubular body key profile (12) formed on the inner surface of the tubular body (2). The inner surface of the frac collar sliding sleeve (5) has an internal sliding sleeve key profile (14).

The embodiments of the present invention and exemplary uses thereof described below describe the ported collar as being a frac collar (1) having ports in the form of frac ports (5), and the tubular (104) as being a casing string. More generally, however, it will be appreciated that the ported collar may define one or more ports for permitting radial fluid communication either into or out of the ported collar, and that the ported collar may be connected to a tubular (104) that is other than a casing string. More generally, therefore, the present invention may be used to control radial fluid communication between inside and outside the ported collar (and hence inside and outside the tubular), in applications other than fracturing or stimulation of a subterranean formation.

Further, the embodiments of the present invention and exemplary uses thereof described below describe the sleeve (10) as being moved to open and close the frac port (5) of the frac collar (1). More generally, however, it will be understood that the sleeve (10) moves to vary an open area of one or more ports of a ported collar. As used herein, "varying an open area of the port" includes changing the area of the port that is not occluded by the sleeve (10) and through which fluid may flow radially. For example, varying an open area of the port includes moving the sleeve (10) from and to positions in which the sleeve (10) occludes none of the area of the port (i.e., a fully open state), in which the sleeve (10) occludes all of the area of the port (i.e., a fully closed state), and states in between the fully open state and the fully closed state.

Resettable Activation Device.

FIG. 2 shows a cross-sectional view of an embodiment of the resettable activation device (20) of the present invention. The activation device (20) is configured to be inserted into the cylindrical tubular body (2) of the frac collar (1). In one embodiment, the activation device (20) comprises a tool mandrel (22), a traveling key (26), and a fixed key profile (29).

Figure 3:
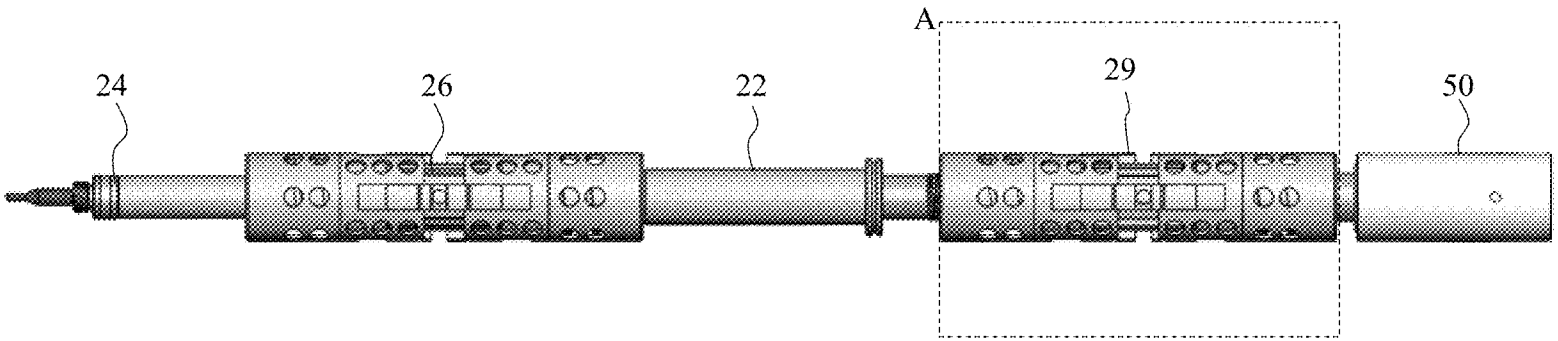
FIG. 3 is a view of an alternative embodiment of an activation device of the present invention, with a hydraulic power module shown.
Figure 4:
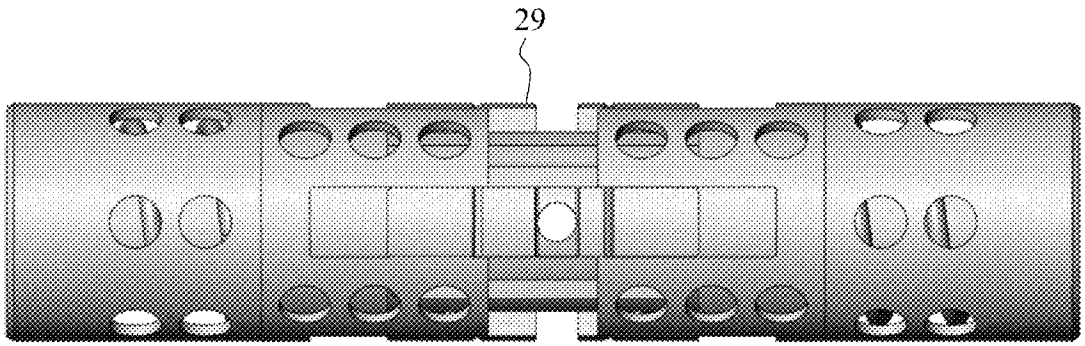
FIG. 4 is a view of the portion "A" of the activation device of FIG. 3, showing the fixed key in a radially retracted position.

The tool mandrel (22) has an upper head (24) adapted to attach to a wireline (106) (see FIG. 1) (or alternatively, an e-line, a coiled tubing string or an e-coil tubing string). The lower portion of the tool mandrel (22) ends with a combinable lower head (27), which may connect to other components of the device (20), such as a hydraulic power module (50), such as shown in FIG. 3.

The traveling key (26) is affixed to a traveling piston (28) slidably disposed on the mandrel (22). The traveling key (26) has an external profile that mates with the internal sliding sleeve key profile (14) on the sliding sleeve (10) of the frac collar (1).

The fixed key (29) is mounted on the tool mandrel (22) by a saddle (30). The fixed key (29) has an external profile which mates with the fixed tubular body key profile (12) on the inner surface of the tubular body (2). Preferably, the external profile of the fixed key (29) is different from the external profile of the traveling key (26), such that the external profile of the fixed key (29) does not fit with the internal sliding sleeve key profile (14), and will therefore slide past the internal sliding sleeve key profile (14) without engaging it.

Figure 5:
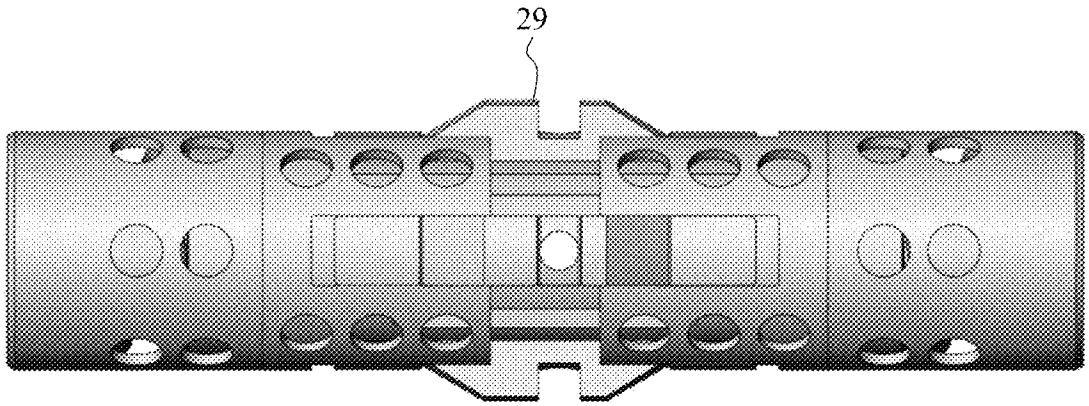
FIG. 5 is a view of the portion "A" of the activation device of FIG. 3, showing the fixed key in a radially deployed position.

Each of the traveling key (26) and the fixed key (29) may be mounted in their respective hydraulic wells (260, 290), each of which is in fluid communication with a hydraulic power module (50) to radially actuate the traveling keys (26) between their inward retracted position (see FIG. 3) and their outward deployed position (see FIG. 5 in respect to key (29)). The keys (26, 29) may be biased, such as by a spring, towards either the inward retracted position, or the outward deployed position. When running into or out of the tubular (104), the keys (26, 29) may be in their inward retracted position. The leading and trailing edges of the keys (26, 29) may be chamfered to facilitate running into and out of the tubular (104).

Referring back to FIG. 2, the embodiment of the device (20) further comprises an anchor/packer assembly (40) for creating a seal against an inner wall of the tubular body (2) of the frac collar (1) so as to prevent fluid flow in the tubular (104) beyond the zone surrounding the frac collar (1) (e.g., in FIG. 1, frac collar (1*b*)), and thereby isolate other frac collars (1) (e.g., in FIG. 1, frac collar (1*c*)) from the fluid flow. The anchor/packer assembly (40) is optional, as it is conceivable for the device (20) to be used in applications where packer isolation been frac collars (1) is not required (e.g., in FIG. 1, if frac collar (1*c*) remains closed after fracturing). In the embodiment shown in FIG. 2, the anchor/packer assembly comprises a packer (42) for engaging the inner surface of the frac collar (1) in a sealed manner, a packer actuating piston (44) and, preferably, a retractable anchor slip (46) for anchoring the device (20) within the tubular body (2) of the frac collar (1). In this embodiment, the packer (42) and packer seat (49) are below the keys (26, 29), but they may be positioned in between the keys (26, 29) in an alternative embodiment. The packer seat (49) is affixed to the frac collar (1), but not to the sliding sleeve (10) of the frac collar (1). In this embodiment, the packer seat (49) is a portion of the tubular body (2) of the frac collar (1) having a reduced internal diameter so as to engage the packer (42) and resist axial movement of the packer (42) at a given pressure rating, while still being at least as large as the specified drift of the tubular body (2) for passage of tools through the tubular body (2). In this embodiment, the packer (42) is disposed between a packer plate (41) and a wedge plate (43). The packer plate (41) engages a lower surface of a centralizer (48), which is further discussed below. The frusto-conical downhole surface of the wedge plate (43) engages a complementary shaped uphole surface of the anchor slips (46).

The traveling piston (28) forms opposing hydraulic chambers (281) and (282) by sealed engagement with the saddle (30). Axial reciprocation of the traveling piston (28) may be accomplished by hydraulic pressure differential between the two chambers (281, 282). In an alternative embodiment, the traveling piston (28) may rotate to align a rotating sliding sleeve with the frac port (5), and the hydraulic actuation may be configured accordingly.

The packer actuating piston (44) also forms opposing hydraulic chambers (441, 442) together with the saddle (30) and a lower member, which may be an optional centralizer (48). A pressure differential between these two chambers (441, 442) will cause axial movement of the packer actuating piston (44) along the tool mandrel (22). When the packer actuating piston (44) is moved axially to compress the packer (42), which may be made of an elastomeric material as is well known in the art, the packer (42) expands outwards to seal against the inside of the tubular body (2) of the frac collar (1).

Figure 8:
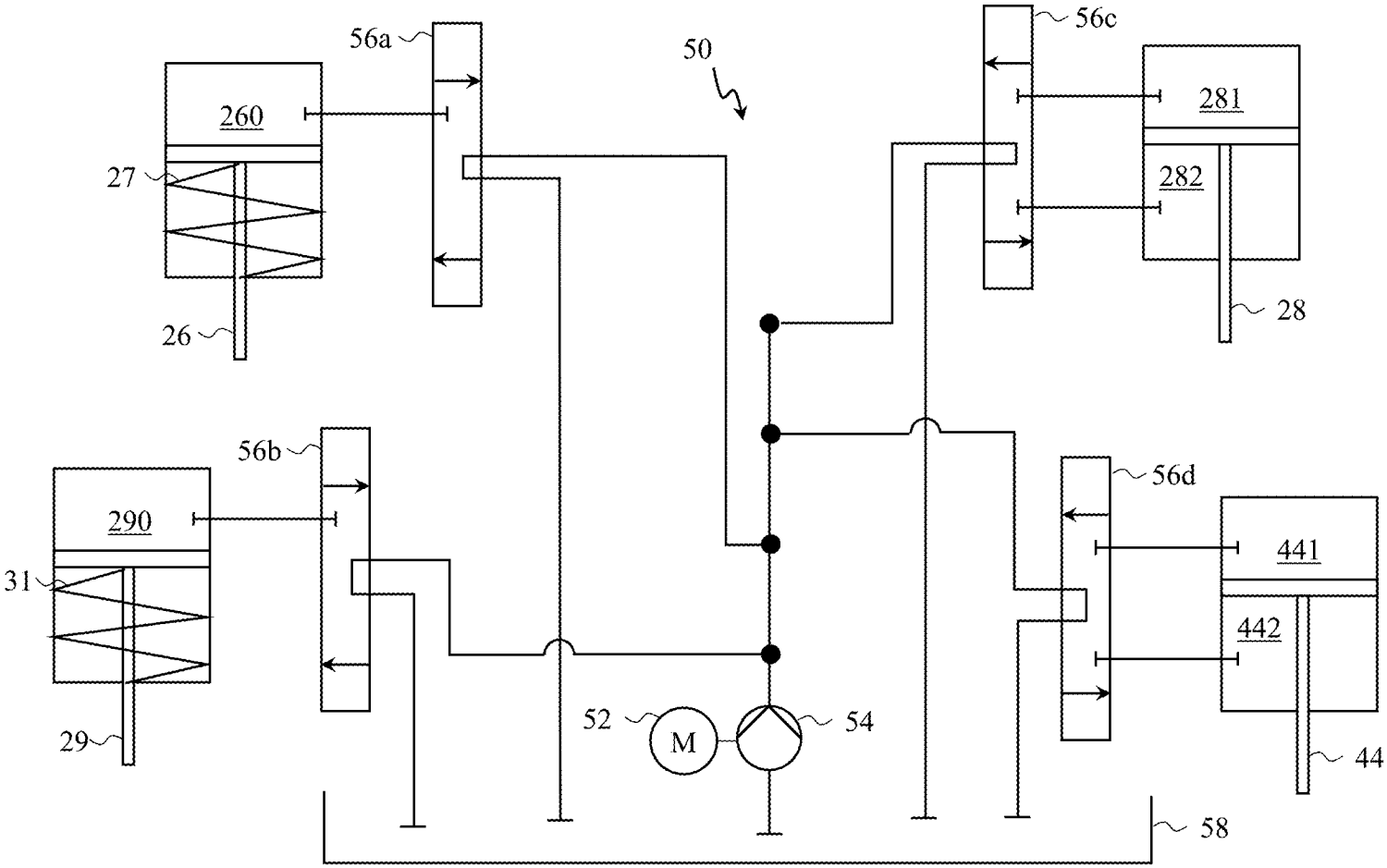
FIG. 8 shows a schematic depiction of an embodiment of a hydraulic power module in relation to other components of the activation device.

FIG. 8 shows an embodiment of a hydraulic power module (50) that is provided with the device (20). In this embodiment, the hydraulic power module (50) comprises four hydraulic subsystems. The first subsystem is configured to radially actuate the fixed key (29) between its inward retracted position, and its outward deployed position, by varying the differential force exerted by hydraulic fluid pressure in the hydraulic well (290), and the force exerted by the biasing spring (31). The second subsystem is configured to actuate the traveling key (26) radially between its inward retracted position, and its outward deployed position, by varying the differential force exerted by hydraulic fluid pressure in the hydraulic well (260), and the force exerted by the biasing spring (27). The third subsystem is configured to reciprocate the traveling piston (28) by varying the hydraulic pressure differential between the two opposing hydraulic chambers (281, 282). The fourth subsystem is configured to reciprocate the packer actuating piston (44) by varying the hydraulic pressure differential between the two opposing hydraulic chambers (441, 442). In one embodiment, the hydraulic subsystems are driven off a single electrical motor (52) and hydraulic pump (54), and are closed hydraulic systems with suitable valves (56*a*, 56*b*, 56*c*, 56*d*), hydraulic fluid reservoir (58), lines and controllers to selectively actuate the moving components of the device (20). Electric power is supplied via wireline (or alternatively, the coiled tubing or e-coil tubing) to the electrical motor (52).

Figure 6:
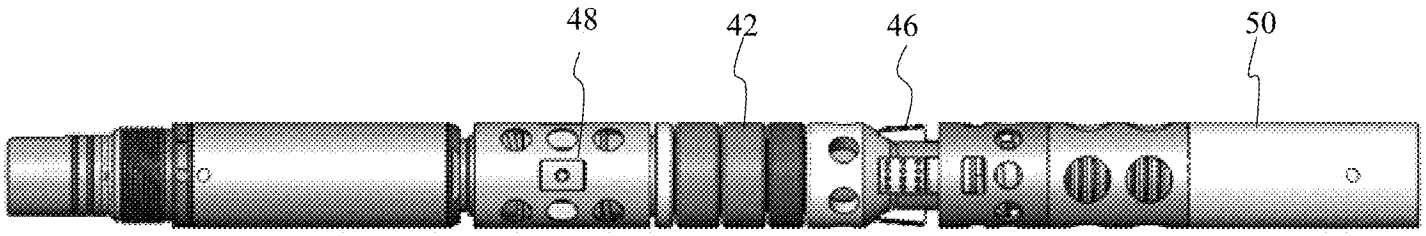
FIG. 6 is a view of a further alternative embodiment of the activation device of the present invention, with centralizer elements, anchor slips and packer elements in radially retracted positions.
Figure 7:
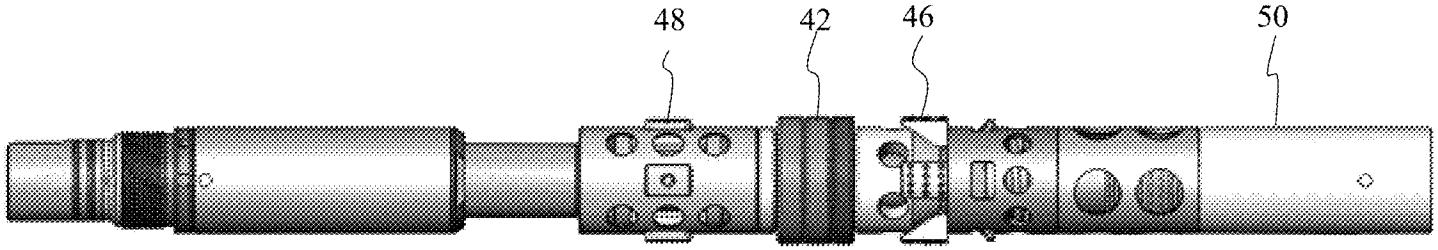
FIG. 7 is a view of the activation device and elements of FIG. 6, with centralizer elements, anchor slips and packer elements in radially deployed positions.

FIGS. 6 and 7 show another embodiment of the activation device (20) with a hydraulic power module (50) connected thereto. In FIG. 6, the packer (42) in a running position, while in FIG. 7, the packer (42) is in a deployed position. In the deployed position, shown in FIG. 7, the packer (42) has been expanded radially outward by downward movement of a packer actuating piston (44), as well as radially outward deployment of centralizer members (48) and anchor slips (46). In one embodiment, both the centralizer members (48) and anchor slips (46) may be actuated by suitable configured ramps (such as the downhole surface of the wedge plate (43)), which force those elements radially outward in response to axial forces.

Method.

Referring to FIG. 1, an exemplary use of the present invention comprises a method of stimulating a subterranean formation that includes a wellbore (102) and a tubular (104) comprising a plurality of frac collars (1*a*, 1*b*, 1*c*) placed in different zones of a subterranean formation. The resettable activation device (20) is used to selectively actuate the frac collars (1*a*, 1*b*, 1*c*), to deliver a stimulation fluid through each frac collar (1*a*, 1*b*, 1*c*) individually.

In general terms, use of one embodiment of the frac collars (1*a*, 1*b*, 1*c*) and the activation device (20) as shown in FIG. 2 may proceed along the following general steps. First, the device (20) may be deployed on a wireline (106) (or alternatively, an e-line, coiled tubing, or an e-coil tubing) to a position below the target frac collar (1*c*) to be used for stimulation. The hydraulic power module (50) is activated to radially actuate the fixed key (29) from its inward retracted position to its outward deployed position. The wireline (106) is then be pulled uphole to slide the activation device (20) into the frac collar (1*c*). When expanded, fixed key (29) will auto-locate into the fixed tubular body key profile (12) of the frac collar (1*c*), and lock the activation device (20) into the frac collar (1*c*), thereby preventing either up-hole or down-hole movement of the activation device (20). At this time, optionally, the packer (42) may be radially actuated, as described above in respect to FIGS. 6 and 7.

Once the fixed key (29) is located into the fixed tubular body key profile (12), over pull on the wireline (106) will be noted at the surface. The hydraulic pressure module (50) will then be used to direct pressure to radially actuate the traveling key (26) from its inward retracted position to its outward deployed position. The traveling key (26) will auto-locate into the internal sliding sleeve key profile (14) of the frac collar sliding sleeve (5), based on the located position of the fixed key (29).

At this time, if not previously deployed, the hydraulic pressure module (50) may then be used to direct pressure to axially stroke the packer actuating piston (44) to generate the compressive force required to overcome a retracting spring and energize the packer (42).

Once both the traveling key (26) and the fixed key (29) have seated, the hydraulic pressure module (50) is used to axially stroke the traveling piston (28) such that the traveling key (26) affixed thereto moves axially towards the fixed key (29), thereby moving the sliding sleeve (10) in the frac collar (1*c*) to its open position.

Stimulation through the open frac port (5) of the frac collar (1*c*) to the formation may now take place with one or both keys (26, 29) preventing the activation device (20) from moving axially (along with the anchor slip (46) if supplied and deployed) and the packer (42) isolating pressure below the frac port (5). Fluid pumped down the tubing string (104) at this time will be diverted through the open frac port (5) of the frac collar (1*c*).

Once the stimulation is completed the frac port (5) of the frac collar (1*c*) may then be shifted closed or left open. The keys (26, 29) may then be retracted, and the packer (42) may be de-energized to release the device (20) from the frac collar (1*c*). The ability to pull the device (20) uphole provides confirmation of release. The wireline (106) is then pulled to position the activation device (20) above the frac port (5) of the frac collar (1*c*). Any movement of the traveling piston (28) should be performed only when the device (20) is positioned above the frac collar (1*c*) to ensure that the sliding sleeve (10) of frac collar (1*c*) is not accidentally stroked closed.

The steps described above may then be repeated in respect to frac collar (1*b*), and then in respect to frac collar (1*a*). Alternatively, the steps described above may be repeated in respect to frac collar (1*a*), before repeating them in respect frac collar (1*b*), if at all. Accordingly, it will be apparent that the system (100) may be used to independently, systematically, and selectively provide the stimulant fluid to the different zones of the formation surrounding frac collars (1*a*, 1*b*, 1*c*).

Definitions and Interpretation

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The invention claimed is:

1. A resettable activation device for insertion into a ported collar for forming part of or for being installed in a tubular that is run into a wellbore defining an axial direction and a radial direction, the ported collar comprising a tubular body defining at least one port permitting radial fluid communication between inside the tubular body and outside the tubular body, and a sleeve movable relative to the at least one port to vary an open area of the port permitting radial fluid communication between inside the tubular body and outside the tubular body, wherein the tubular body defines a radially inward facing tubular body key profile, and wherein the sleeve defines a radially inward facing sleeve key profile, the resettable activation device comprising:

(a) a mandrel comprising an uphole head adapted to attach to a wireline or a coiled tubing string;

(b) a fixed key affixed to the mandrel, wherein the fixed key defines a radially outward facing fixed key profile for mating with the tubular body key profile to fix an axial position of the activation device when disposed in the tubular body;

(c) a traveling piston disposed on the mandrel for reciprocating axially on the mandrel;

(d) a traveling key affixed to traveling piston, wherein the traveling key defines a radially outward facing traveling key profile for mating with the sleeve key profile; and (e) a hydraulic power module configured for actuating axial reciprocation of the traveling piston on the mandrel when the traveling key profile is mated with the sleeve key profile, thereby moving the sleeve to vary the open area of the port permitting radial fluid communication between inside the tubular body and outside the tubular body.

2. The resettable activation device of claim 1, wherein the fixed key profile is different from the traveling key profile, such that the fixed key profile is not mateable with the sleeve key profile.

3. The resettable activation device of claim 1, wherein the hydraulic power module is further configured for actuating the fixed key relative to the mandrel between a radially retracted position in which the fixed key profile is not mateable with the tubular body key profile, and a radially deployed position in which the fixed key profile is mateable with the tubular body key profile.

4. The resettable activation device of claim 1, wherein the hydraulic power module is further configured for actuating the traveling key relative to the mandrel between a radially retracted position in which the traveling key profile is not mateable with the sleeve key profile, and a radially deployed position in which the traveling key profile is mateable with the sleeve key profile.

5. The resettable activation device of claim 1, further comprising:

(a) a packer mounted on the mandrel, wherein the packer is responsive to axial compression to expand radially and seal against an inner surface of the tubular body of the ported collar; and (b) a packer actuating piston disposed on the mandrel for reciprocating axially on the mandrel, wherein axial reciprocation of the packer actuating piston alternately axially compresses and decompresses the packer;

(c) wherein the hydraulic power module is further configured for actuating axial reciprocation of the packer actuating piston on the mandrel.

6. The resettable activation device of claim 1, further comprising:

(a) an anchor slip for anchoring the device within the tubular body of the ported collar, or a centralizer to centralize the device within the ported collar, wherein the anchor slip or the centralizer is responsive to an axial force to move from a radially retracted position in which the anchor slip or the centralizer does not engage an inner surface of the tubular body of the ported collar, to a radially deployed position in which the anchor slip or the centralizer engages the inner surface of the tubular body of the ported collar; and (b) a ramp member disposed on the mandrel for reciprocating axially on the mandrel to apply the axial force to the anchor slip or the centralizer.

7. A method for operating at least one ported collar comprising a tubular body forming part of or being installed in a tubular that is run into a wellbore defining an axial direction and a radial direction, and defining at least one port permitting radial fluid communication between inside the tubular body and outside the tubular body, and a sleeve movable relative to the at least one port to vary an open area of the port permitting radial fluid communication between inside the tubular body and outside the tubular body, the method comprising the steps of:

(a) inserting an activation device into the tubular body of a first one of the at least one collar, wherein the activation device comprises:

(i) a fixed key defining a radially outward facing fixed key profile; and (ii) a traveling key movable relative to the fixed key, and defining a radially outward facing traveling key profile; and (iii) a packer that is responsive to axial compression to expand radially and seal against an inner surface of the tubular body of the first ported collar, and a packer actuating piston movable to axially compress the packer;

(b) mating the fixed key profile with the tubular body key profile of the first ported collar to fix an axial position of the activation device in the tubular body of the first ported collar;

(c) mating the traveling key profile with the sliding sleeve key profile of the first ported collar; and (d) moving the traveling key relative to the fixed key to move the sliding sleeve of the first ported collar to vary the open area of the port permitting radial fluid communication between inside the tubular body and outside the tubular body; and (e) moving the packer actuating piston to axially compress the packer and expand the packer radially to seal against the inner surf ace of the tubular body of the first ported collar.

8. A method for operating at least one ported collar comprising a tubular body forming part of or being installed in a tubular that is run into a wellbore defining an axial direction and a radial direction, and defining at least one port permitting radial fluid communication between inside the tubular body and outside the tubular body, and a sleeve movable relative to the at least one port to vary an open area of the port permitting radial fluid communication between inside the tubular body and outside the tubular body, the method comprising the steps of:

(a) inserting an activation device into the tubular body of a first one of the at least one collar, wherein the activation device comprises:

(i) a fixed key defining a radially outward facing fixed key profile;

(ii) a traveling key movable relative to the fixed key, and defining a radially outward facing traveling key profile; and (iii) an anchor slip for anchoring the device within the tubular body of the ported collar, a centralizer to centralize the device within the ported collar, wherein the anchor slip or the centralizer is responsive to an axial force to move from a radially retracted position in which the anchor slip or the centralizer does not engage an inner surface of the tubular body of the ported collar, to a radially deployed position in which the anchor slip or the centralizer engages the inner surface of the tubular body of the ported collar;

(b) mating the fixed key profile with the tubular body key profile of the first ported collar to fix an axial position of the activation device in the tubular body of the first ported collar;

(c) mating the traveling key profile with the sliding sleeve key profile of the first ported collar;

(d) moving the traveling key relative to the fixed key to move the sliding sleeve of the first ported collar to vary the open area of the port permitting radial fluid communication between inside the tubular body and outside the tubular body; and (e) moving a ramp member to apply the axial force to the anchor slip.

* * * * *